US005797778A

United States Patent [19]

Ito et al.

[11] Patent Number: 5,797,778

[45] Date of Patent: Aug. 25, 1998

[54] MOUNTING ARRANGEMENT FOR MARINE PROPULSION ENGINE

[75] Inventors: Ryoichi Ito; Masamichi Fujiwara, both of Iwata, Japan

[73] Assignee: Yamaha Hatsudoki Kabushiki Kaisha, Shizuoka-ken, Japan

[21] Appl. No.: 791,107

[22] Filed: Jan. 30, 1997

[30] Foreign Application Priority Data

Jan. 30, 1996 [JP] Japan ..... 8-014157

[51] Int. Cl.[6] ..... B63H 21/30

[52] U.S. Cl. ..... 440/111

[58] Field of Search ..... 440/38, 53, 111, 440/112; 248/636, 638, 659, 671, 675; 180/300, 312, 297, 291; 114/220

[56] References Cited

U.S. PATENT DOCUMENTS

| | | | |
|---|---|---|---|
| 4,003,330 | 1/1977 | Compton | 440/111 |
| 4,831,822 | 5/1989 | Yoshimura . | |
| 4,903,662 | 2/1990 | Hirukawa et al. . | |
| 4,905,956 | 3/1990 | Zemlicka et al. | 248/638 |
| 4,957,461 | 9/1990 | Nakayama . | |
| 4,957,462 | 9/1990 | Erickson | 440/111 |
| 5,254,023 | 10/1993 | Kobayashi | 440/38 |
| 5,334,063 | 8/1994 | Inoue et al. . | |
| 5,460,552 | 10/1995 | Blanchad et al. | 440/111 |

*Primary Examiner*—Ed L. Swinehart

*Attorney, Agent, or Firm*—Knobbe, Martens, Olson & Bear, LLP

[57] ABSTRACT

The present invention is a mounting arrangement for an engine powering a water propulsion device of a watercraft having a hull. The engine is connected to the hull with three engine mounts. A first pair of mounts are positioned on opposite sides of the engine, and the third mount connects one end of the engine to the hull. The side mounts are positioned equidistantly from a line passing through a center of gravity of the engine and parallel to a line extending along the crankshaft of the engine. The third mount is positioned along the line passing through the center of gravity. Each mount comprises a pad engaging a bracket extending from the engine. Each pad is positioned on a threaded shaft which engages a threaded mounting of connected to the hull, whereby the height of each pad, and thus the engine, may be changed with respect to the hull without changing the position of the engine relative to the pads.

19 Claims, 9 Drawing Sheets

MOUNTING ARRANGEMENT FOR MARINE PROPULSION ENGINE

FIELD OF THE INVENTION

The present invention relates to an engine mounting arrangement, and more particularly, to an engine mounting arrangement for an engine mounted to the hull of a watercraft and powering a water propulsion device of the watercraft.

BACKGROUND OF THE INVENTION

The movement of parts of internal combustion engines generate vibrations. These vibrations range across a wide frequency, partially as a result of the fact that the various parts of the engine move at a wide range of speeds during operation of the engine.

These engine vibrations are transmitted to whatever structure the engine is secured to via the engine mounting structure. In many applications, the amplitude and frequency of the transmitted vibration may be damaging to the surrounding structure or at least very undesirable to the operator of the device which is powered by the engine.

This is true in the case of watercraft which are powered by engines. Those watercraft powered by inboard engines have the engine mounted to a hull of the watercraft and have their outputs either directly or indirectly connected to a water propulsion device positioned outside of the hull. The connection of the engine to the hull results in the transmission of the engine vibration to the hull and thus all other portions of the watercraft connected thereto. This includes the steering mechanism, floorboard, seats and the like. When the operator or user of the watercraft is in contact with any of these features, the operator or user is also subject to the engine vibration. In addition, the engine vibration typically results in substantial noise generation. This noise is undesirable to the operator of the watercraft.

In the prior art, engine mounts have been proposed for isolating the engine from the hull to which the engine is mounted for limiting the transmission of engine vibration thereto. These mounting arrangements have suffered from numerous drawbacks. First, in many instances, the mounts have simply failed in adequately dampening the vibration and preventing the transmission of the vibrations. Second, in some instances the mounting arrangement has been such that the center of elasticity of the mounts is such that at some times the arrangement is relatively effective in dampening the vibrations, but at other times, independent vibrational modes associated with the center of gravity and center of elasticity may couple, causing a dangerous vibrational mode which is not damped.

In some instances, it is necessary to change the height of the engine with respect to the hull. In most engine mounting arrangements, this is accomplished by changing the distance between the engine and the pad of the mount upon which the engine rests. As can be understood, changing the distance between the engine and the mount has the effect of changing the damping constant, thus preventing the desired vibration dampening.

An engine mounting arrangement which effectively dampens engine vibration and which allows for adjustments to the height of the engine, is desired.

SUMMARY OF THE INVENTION

The present invention is an engine mounting arrangement for an engine powering a water propulsion device of a watercraft. The engine mounting arrangement advantageously dampens the engine generated vibrations from the hull of the watercraft over the engine's operating speed range. In addition, the mounting arrangement allows the height of the engine to be varied without changing the dampening constant or factor, thus maintaining the effectiveness of the vibration isolation features of the arrangement regardless of the position of the engine.

Preferably, the mounting arrangement includes three engine mounts. A first and second mount are positioned on opposite sides of a lower portion of the engine. These mounts preferably comprise outwardly extending engine brackets resting upon vibration dampening pads. Means are provided for changing the height of the pads, and thus the engine mounted thereon, with respect to the hull. This means preferably comprises a threaded shaft extending downwardly from each pad for engagement with a threaded mounting connected to the hull.

Most importantly, the first and second mounts are spaced equidistantly from a line extending through a center of gravity of the engine and parallel to a line extending along a crankshaft of the engine. In this manner, the center of elasticity of these mounts lies along a line passing through the center of gravity of the engine.

The third mount preferably joins the rear end of the engine to an upwardly extending transom portion of the hull. This third mount preferably comprises a bracket extending from the end of the engine for engagement with a vibration isolating and dampening pad. The pad is connected, via a shaft, to a plate mounted to the transom. Again, means are preferably provided for changing the height of the pad, and thus the engine, relative to the transom. This means preferably comprises threads on the shaft for engagement with a threaded fastener of the plate mounted to the transom. This third mount is preferably positioned along the line extending through the center of gravity.

In an alternative embodiment, the first and second engine mounts positioned on opposite sides of the engine are tilted towards one another and the center of the engine. A line passing through each mount extends in a plane passing through the center of gravity of the engine.

The mounting arrangement of the present invention has the advantage that the height of the engine may be changed without changing the dampening constant of the mounts. In addition, the center of elasticity of the mounts is aligned with the center of gravity of the engine, whereby dual modes of vibration are prevented.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
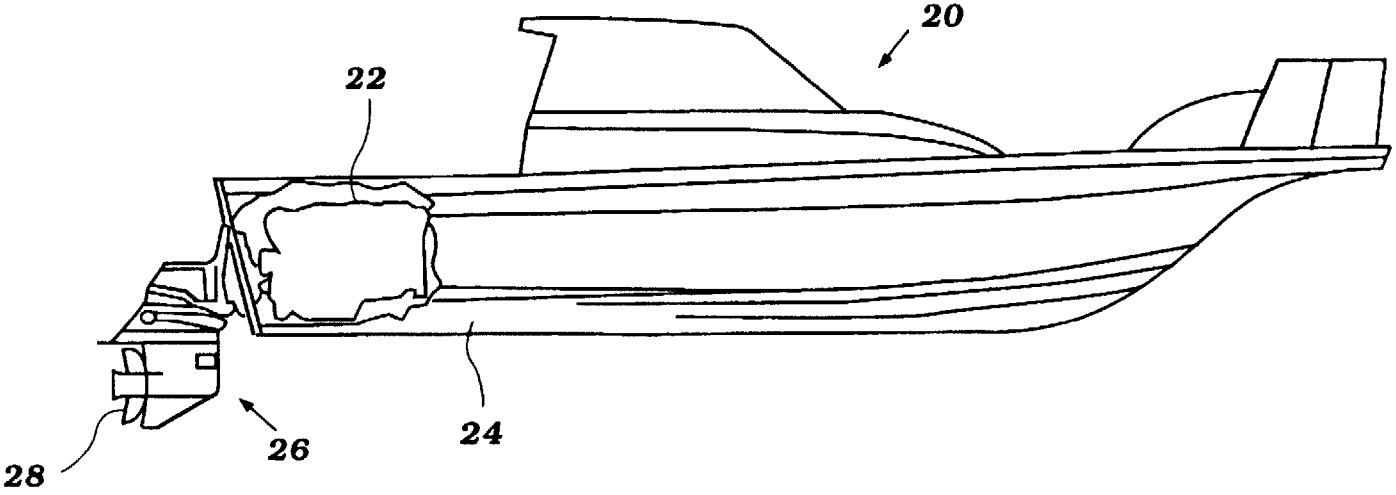
FIG. 1 is a side view of a watercraft having an engine directly coupled to a water propulsion device, the engine mounted to the watercraft in accordance with the prior art.

FIG. 1 illustrates a watercraft 20 having an engine 22 mounted to a hull 24 of the watercraft in accordance with the prior art. In the arrangement illustrated, the engine output, such as an end of a crankshaft extending therefrom, is directly coupled to a water propulsion device 26. As illustrated, the water propulsion device 26 is a propeller 28.

Figure 2:
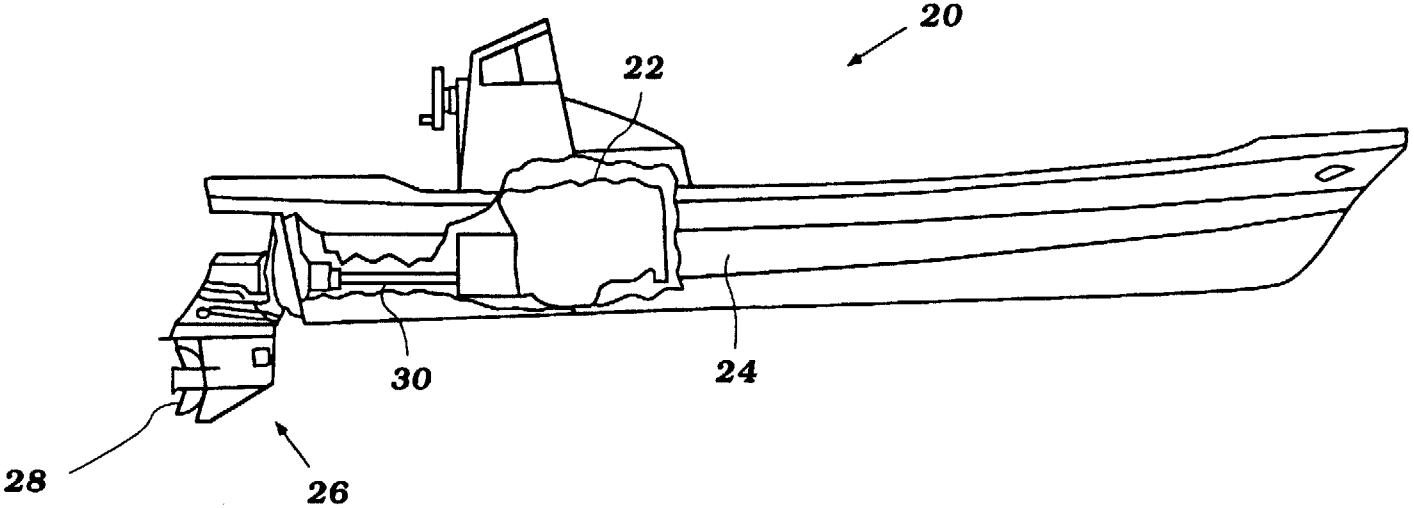
FIG. 2 is a side view of a watercraft having an engine coupled to a water propulsion device via an elongate drive shaft, the engine mounted to the watercraft in accordance with the prior art.

FIG. 2 illustrates a watercraft 20 having an engine 22 mounted to a hull 24 of the watercraft in accordance with a second arrangement in accordance with the prior art. In this arrangement, the engine output drives an elongate shaft 30 which is coupled to the water propulsion device 26.

FIGS. 3–6 illustrate an engine 122 mounted to a hull 124 of a watercraft 120 in accordance with a first embodiment mounting arrangement of the present invention. In general, the engine mounting arrangement comprises connecting the engine 122 to the hull 124 with two lower, side mounts 132*a,b* and a rear mount 134. The engine mounting arrangement results in the center of elasticity of the mounts 132*a,b*, 134 being coincident with a line passing through the center of gravity of the engine 122, and where the height of the engine with respect to the hull 124 may be adjusted without changing the dampening constant.

Figure 3:
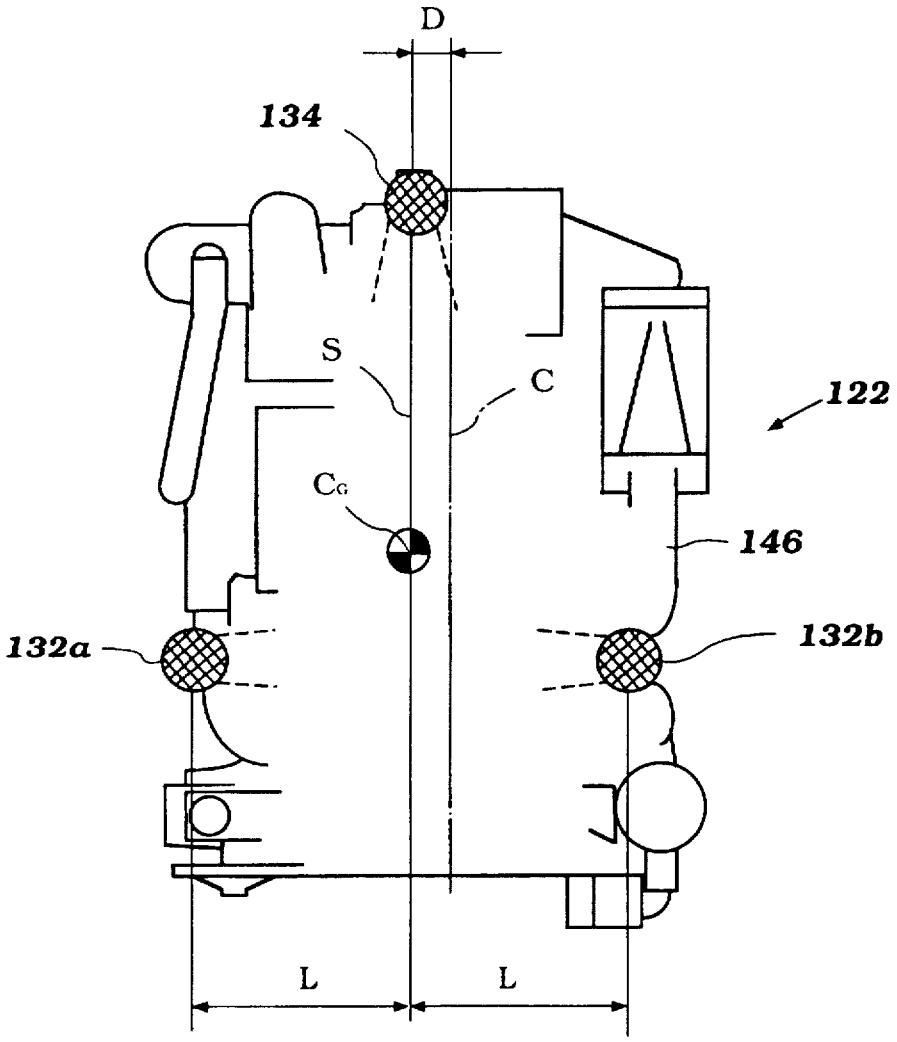
FIG. 3 is a schematic top view of an engine mounted to a hull of a watercraft in accordance with the engine mounting arrangement of the present invention.
Figure 4:
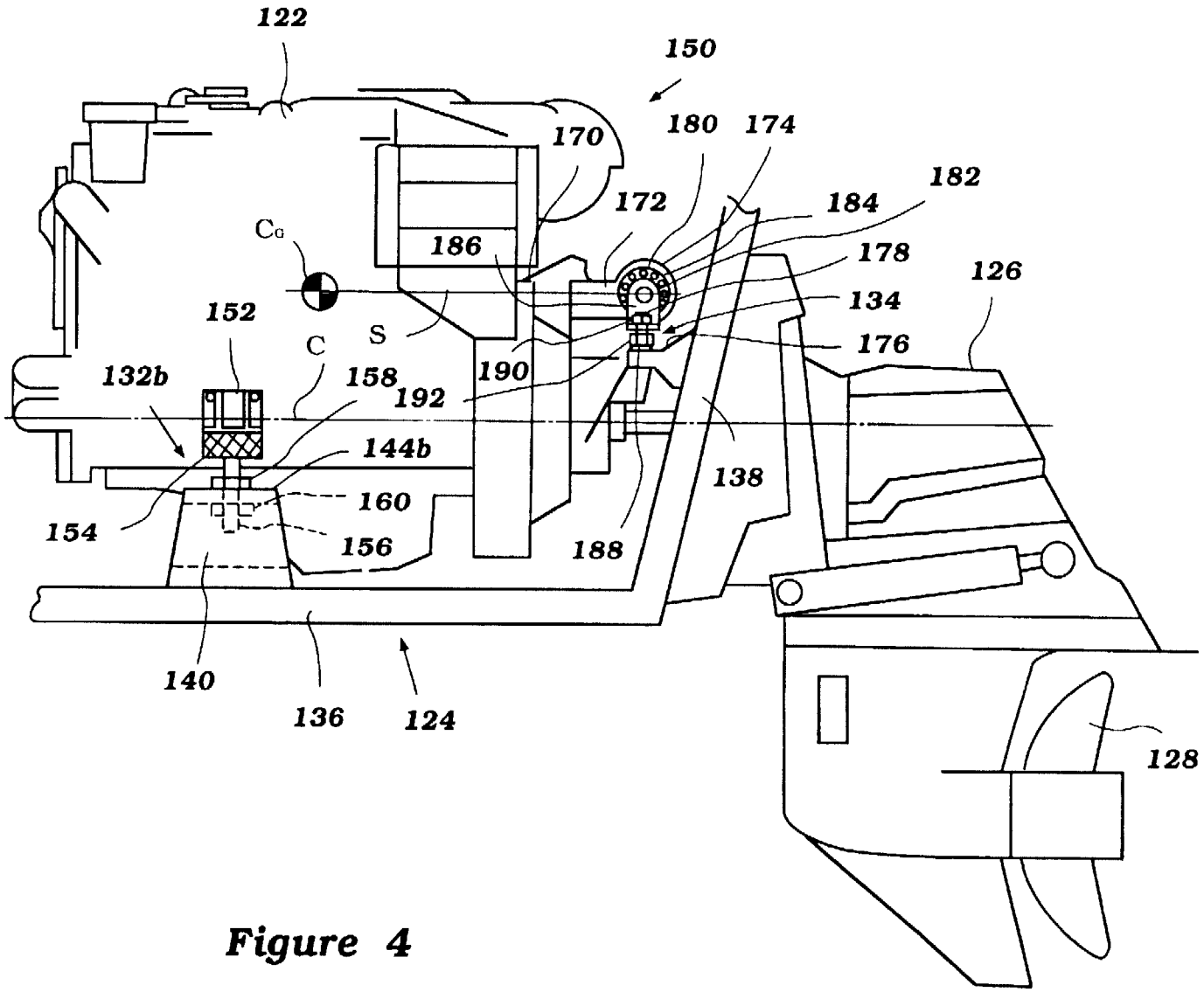
FIG. 4 is a side view of the engine illustrated in FIG. 3 coupled to a water propulsion device of a watercraft and mounted in accordance with the engine mounting arrangement of the present invention.

As illustrated in FIGS. 3 and 4, the hull 124 preferably includes a bottom section 136 and an upwardly extending transom 138 at the stem portion of the watercraft 120. A raised engine support 140 extends from the bottom section 136 of the hull 124 for supporting the engine 122 at its outer side portions while accommodating the downwardly extending crankcase portion 142 thereof. This engine support 140 has inwardly extending supports 144*a,b* extending from upwardly extending portions of thereof.

The engine 122 may be of any type known to those skilled in the art having an output for powering a water propulsion device of the watercraft 120. As illustrated, the engine 122 is a multi-cylinder, piston-type internal combustion engine. In accordance with the construction of these types of engines, as is well known to those in the art, the engine 122 includes a cylinder block 146. Pistons (not shown) within the engine 122 drive a crankshaft 142 which is journalled for rotation with respect to the cylinder block 146 and which extends from a rear end 150 of the engine 122.

As best illustrated in FIG. 4, the crankshaft 142 of the engine 122 extends in driving engagement with a water propulsion device 126. As illustrated, this device is a propeller 128. The crankshaft 142 extends along a line C through the engine 122, as illustrated in FIGS. 3–5.

The engine 122 has a center of gravity $C_G$. As illustrated in FIG. 4, in the vertical plane the center of gravity $C_G$ is positioned above the line C of the crankshaft 142. The center of gravity $C_G$ is positioned to one side of the line C, along a line S, in the horizontal plane, as illustrated in FIG. 3.

Figure 5:
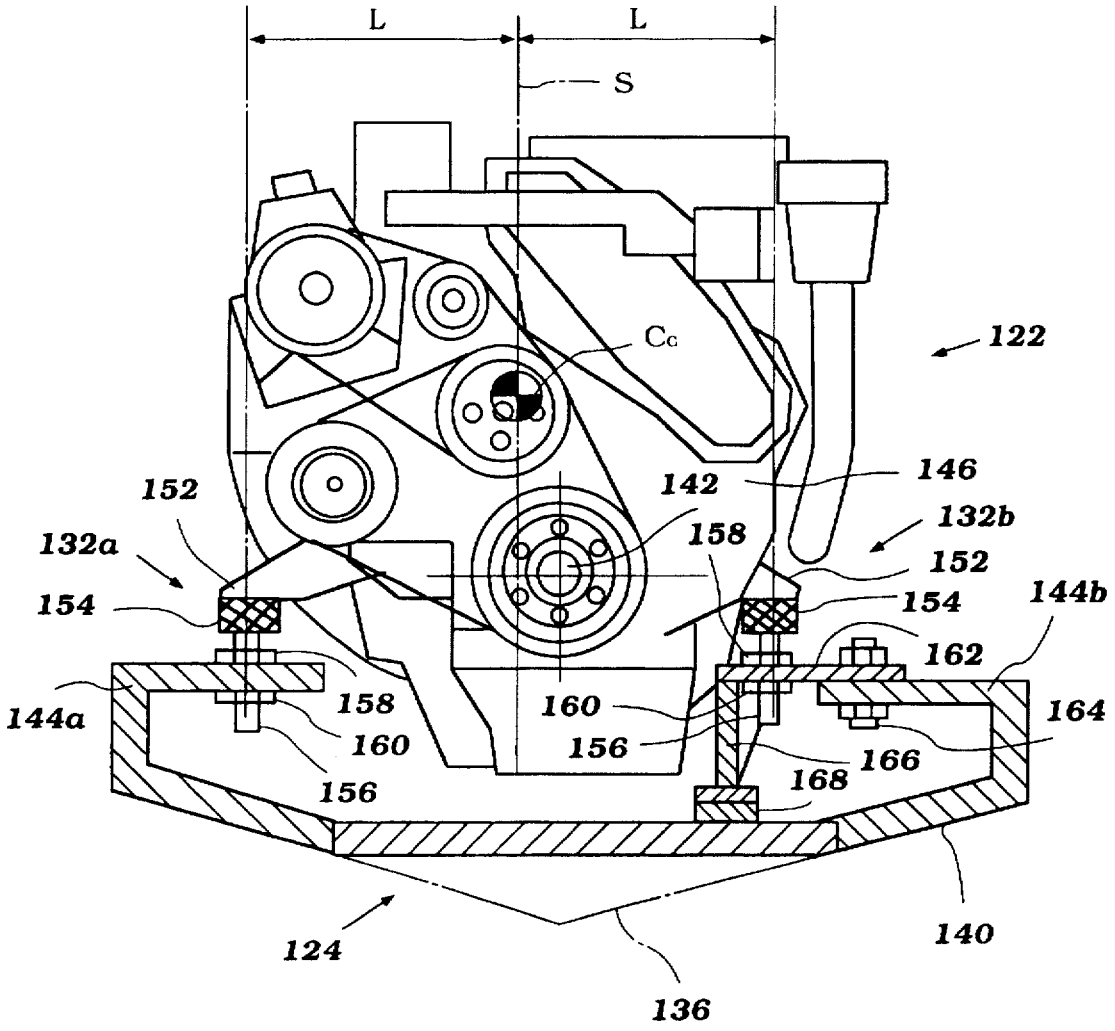
FIG. 5 is an end view of the engine illustrated in FIG. 3 and mounted to the hull in accordance with the mounting arrangement of the present invention.

As illustrated in FIGS. 4 and 5, a bracket 152 extends outwardly from each side of the cylinder block 146 of the engine 122 near the bottom thereof and between its ends. The brackets 152 rest upon a pad 154 of the respective side engine mounts 132*a,b*.

Each side engine mount 132*a,b* preferably comprises the pad 154 connected to a shaft 156 which engages the hull 136 of the watercraft 120 via the engine support 140. The pad 154 is preferably constructed from rubber or a similar vibration dampening and isolating material. The pad 154 is positioned at the top end of the shaft 156, the shaft being threaded on an outer surface over at least a section between its ends.

Means are provided for raising and lowering the height of the engine 122 with respect to the hull 124. Preferably, this means causes the engine 122 to be lowered between the pad 154 and the hull 124, and not between the engine 122 and the pad 154 or mount. In particular, a pair of adjusting nuts 158, 160 engage each shaft 156, which is threaded, for adjusting the position of the shaft 156 relative to the hull 136. As illustrated, the shaft 156 of the left mount 132*a* (as viewed from the front of the engine 122 to the rear 150) passes through a bore in the inwardly extending support 144*a*. One adjusting nut 158 is positioned on the top side of the support 144*a*, and the other adjusting nut 160 is provided on the bottom side of the support 144*a*. This arrangement permits the shaft 156, and thus the pad 154 and engine resting thereon, to be raised and lowered with respect to the hull 124.

The shaft 156 of the right mount 132*b* (as viewed from the front of the engine 122 to the rear 150) passes through a plate 162. The plate 162 extends from the support 144*b* inwardly towards the engine 122. The plate 162 is connected to the support 144*b* at one end by a bolt 164, and at its other end by a downwardly extending leg 166 which rests on a pad 168. The use of the plate 162 allows the engine support 140 to accommodate a variety of engines having their brackets 152 spaced differing distances apart. In this arrangement, the shaft 156 extends through the plate 162, with one adjusting nut 158 positioned on the top side, and the other adjusting nut 160 positioned on the bottom side of the plate 162.

Figure 6:
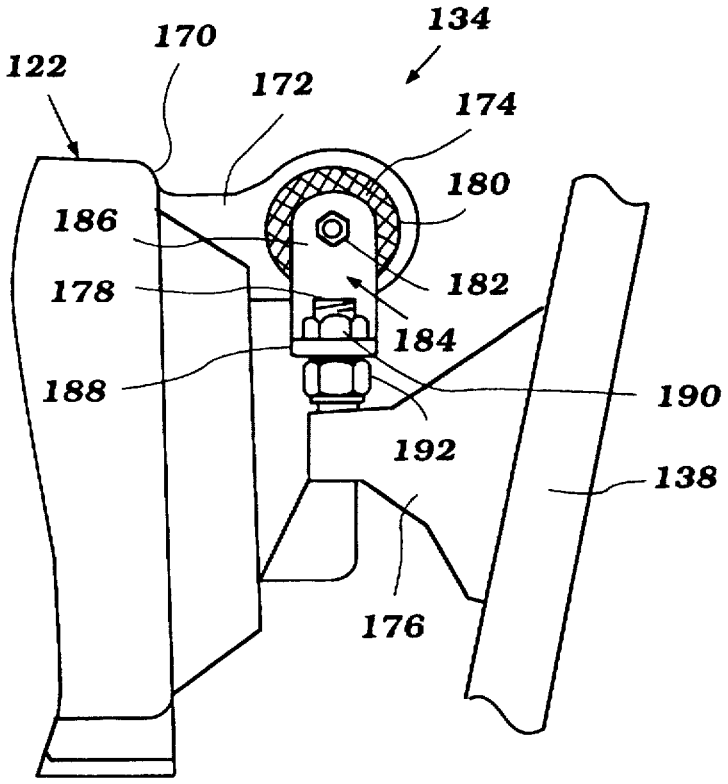
FIG. 6 is an enlarged view of a mount of the mounting arrangement of the present invention connecting the end of the engine to the hull of the watercraft.

The rear mount 134 is best illustrated in FIGS. 4 and 6. As illustrated therein, the engine 122 includes a flywheel housing 170 at its rear end 150 for enclosing a flywheel (not shown) positioned on the crankshaft 142 of the engine. An engine mounting bracket 172 extends from the rear end 150 of the engine 122. The bracket 172 has a bore 174 extending therethrough in a horizontal plane and perpendicular to the crankshaft line C.

A support plate 176 extends inwardly from the transom 138, the plate 176 having an upwardly extending pin or stud 178. The pin 178 is preferably threaded on the outer surface thereof.

A pad 180 is positioned within the bore 174 of the engine mounting bracket 172. The pad 180 is generally cylindrical, but includes a shaft 182 extending through the center thereof. The shaft 182 is rotatably connected to a mounting plate 184 which is generally "L"-shaped. The shaft 182 extends through one leg 186 of the plate 184, while the other leg 188 of the plate 184 has a bore through which the pin 178 extends.

Means are provided for adjusting the height of the rear end 150 of the engine 122 with respect to the hull 124. Preferably, this means comprises a means for raising and lowering the plate 184 which is connected to the engine 122 through the pad 180 of the mount 134. In particular, an adjusting nut 190 is provided on the pin 178 above the leg 188 of the plate, and a similar adjusting nut 192 is provided on the pin 178 below the leg 188 of the plate 184. By loosening the top nut 190 and then rotating the bottom nut 192, the plate 184 may be raised upwardly along the pin 178, thus raising the rear end 150 of the engine 122 with respect to the hull 124. Of course, movement of the nuts 190,192 in the opposite direction will lower the engine 122.

As illustrated in FIGS. 3 and 5, the side mounts 132*a,b* are positioned equidistant (by a distance "L") from the line S which passes through the center of gravity $C_G$. The rear engine mount 134 is positioned directly along the line S passing through the center of gravity $C_G$, as viewed both in the vertical and horizontal planes.

Figure 7:
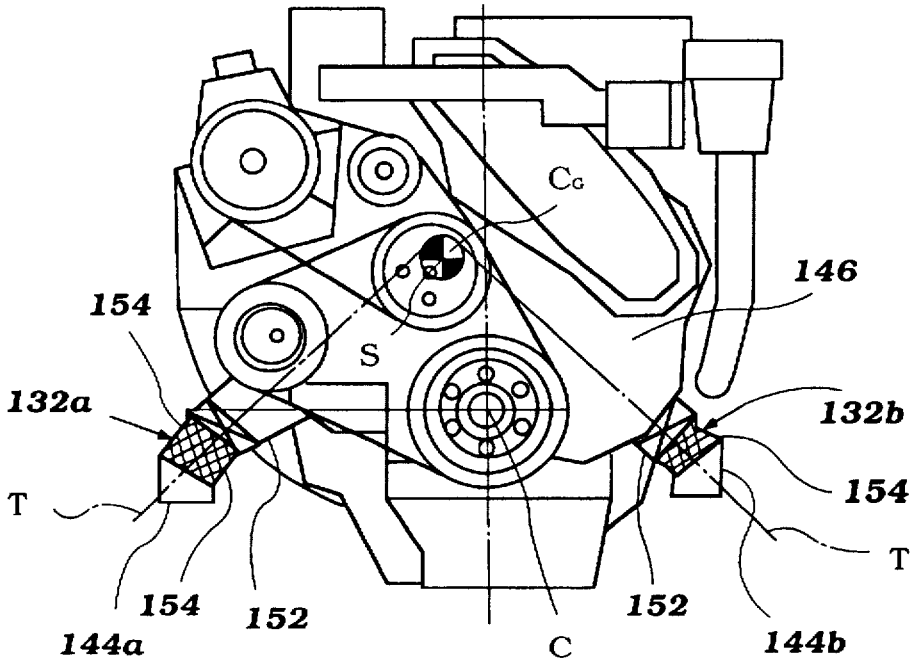
FIG. 7 is a end view of an engine mounted to a watercraft in accordance with an alternate embodiment engine mounting arrangement of the present invention.

FIG. 7 illustrates an alternate embodiment engine mounting arrangement in accordance with the present invention. In this figure, like parts have retained like element numbers with respect to the above-described embodiment. In this arrangement, the pads 154 of the mounts 132*a,b* are tilted inwardly along lines T which lie in planes passing through the center of gravity $C_G$.

Figure 8A:
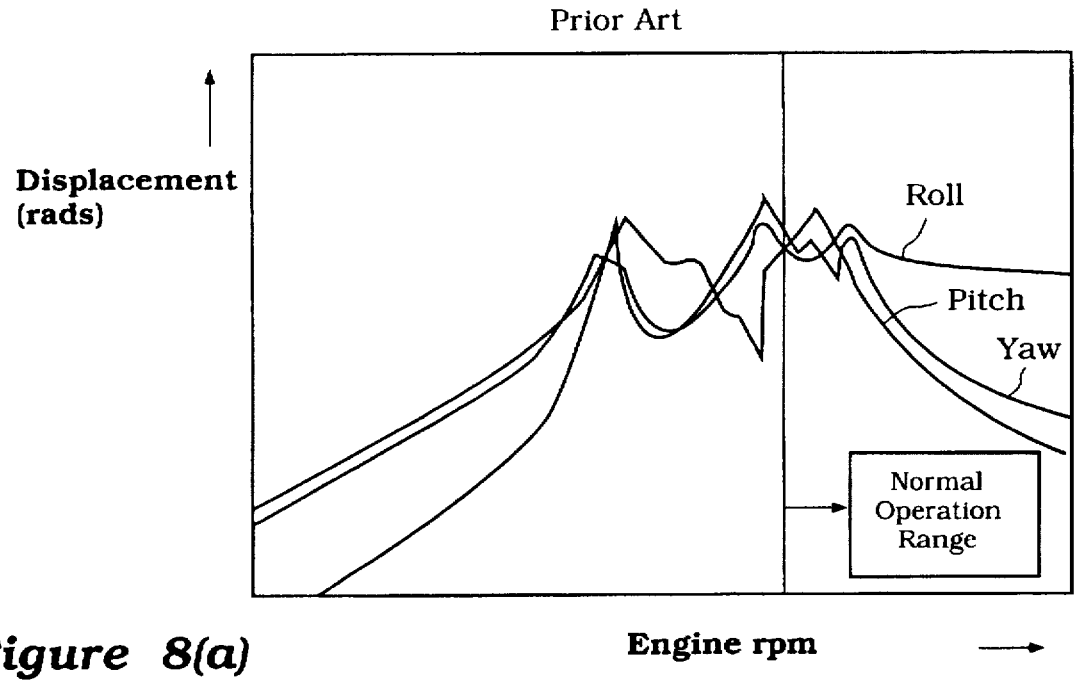
FIG. 8*a* is a graph illustrating the yaw, roll and pitch displacement of an engine mounted in accordance with an engine mounting arrangement of the prior art.
Figure 8B:
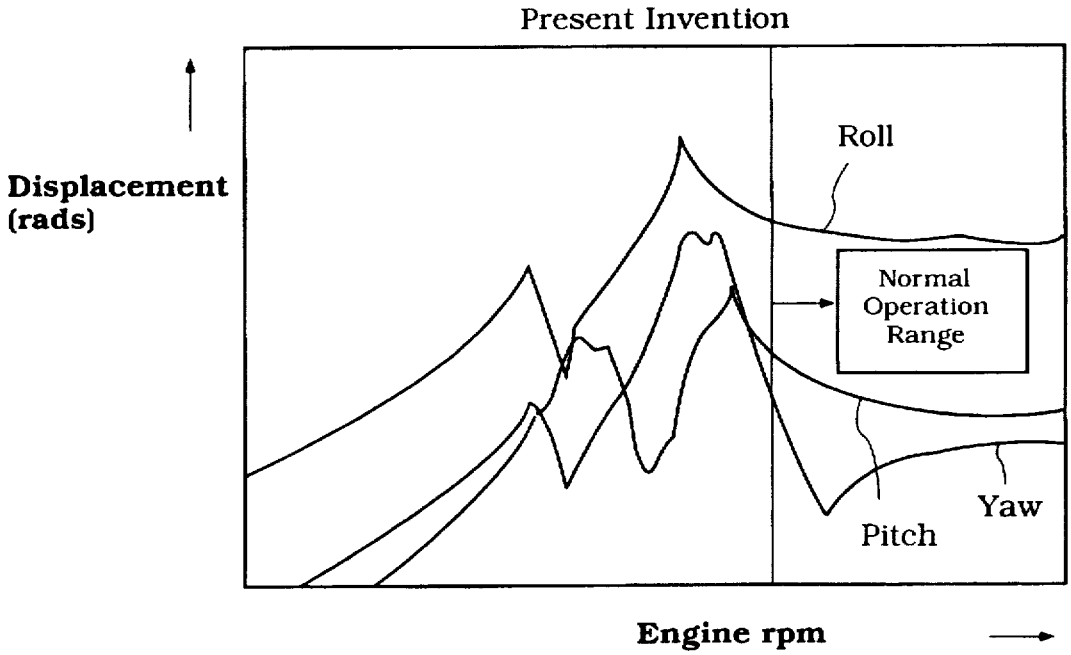
FIG. 8*b* is a graph illustrating the yaw, roll and pitch displacement of an engine mounted in accordance with the engine mounting arrangement of the present invention.

FIGS. 8(*a*) and 8(*b*) illustrate the displacement of an engine mounted in accordance with the prior art and one mounted in accordance with the present invention. These figures illustrate the roll (i.e. rotational movement of the engine about an axis passing therethrough parallel to the crankshaft), the pitch (i.e. raising and lowing of the front/rear of the engine in the vertical plane) and yaw (i.e. side-to-side movement of the engine in the horizontal plane). As illustrated therein, the movement of the engine 122 in its normal operational range is significantly reduced with the engine mounting arrangement of the present invention.

Figure 9A:
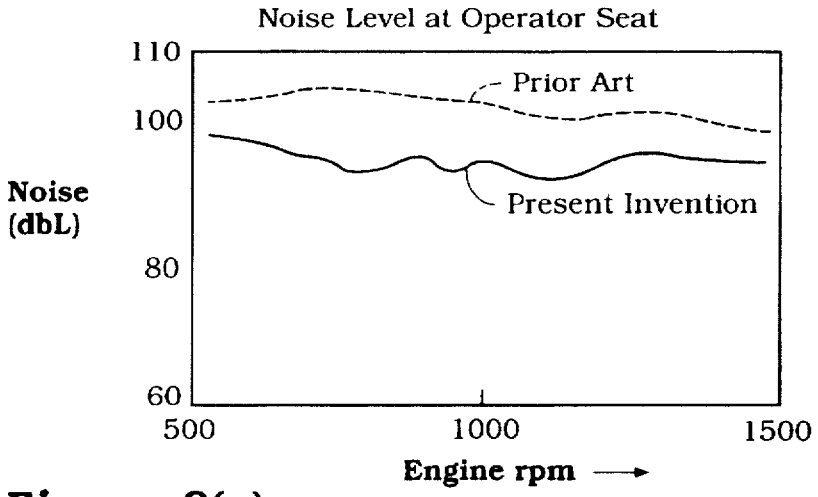
FIG. 9*a* is a graph illustrating noise level at the operator's seat over a range of engine rpm, as between an engine mounted in accordance with the prior art and one mounted in accordance with the present invention.
Figure 9B:
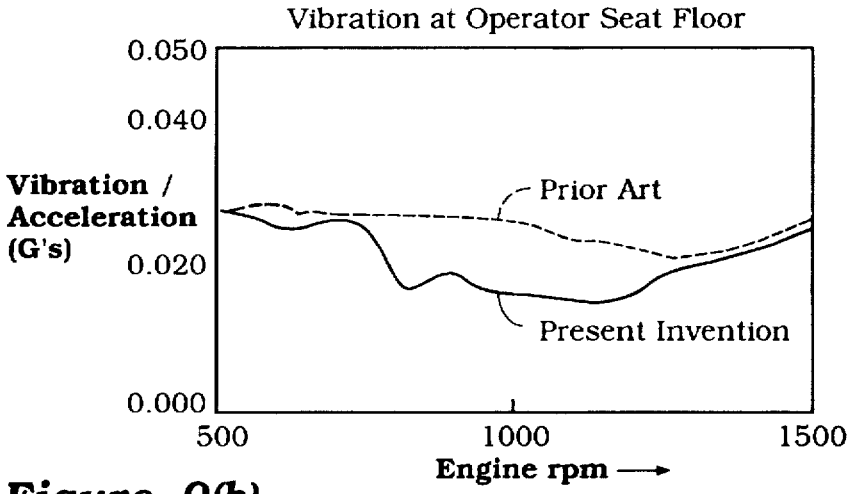
FIG. 9*b* is a graph illustrating the vibration level at the operator seat floor over a range of engine rpm, as between an engine mounted in accordance with the prior art and one mounted in accordance with the present invention.
Figure 9C:
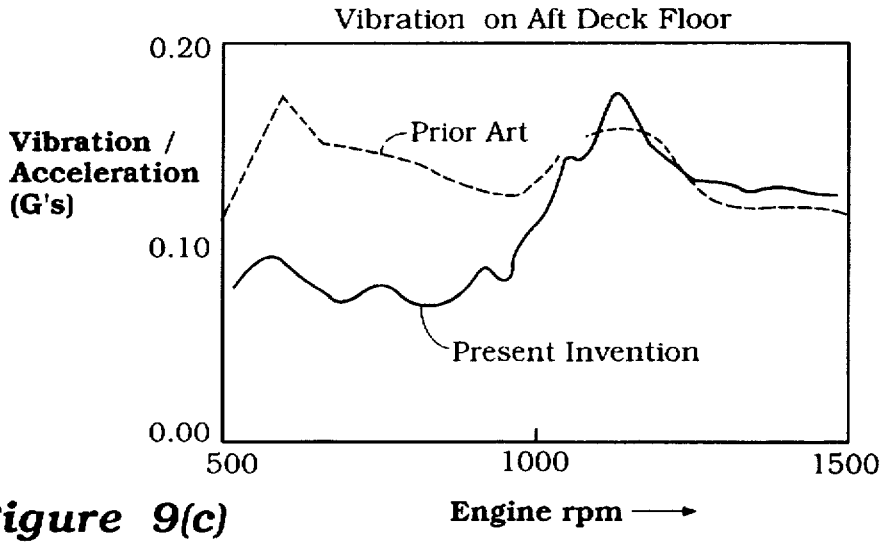
FIG. 9*c* is a graph illustrating the vibration level at the aft deck floor over a range of engine rpm, as between an engine mounted in accordance with the prior art and one mounted in accordance with the present invention.

FIG. 9(*a*) illustrates that the noise level of the watercraft 120 at the operator's seat is significantly reduced when the engine is mounted in accordance with the mounting arrangement of the present invention, as compared to the prior art. FIG. 9(*b*) illustrates that the vibration level at the operator seat floor of a watercraft having the engine mounted in accordance with the mounting arrangement of the present invention is reduced as compared to that where the engine is mounted in accordance with the prior art. Lastly, FIG. 9(*c*) illustrates that the vibration level at the aft deck floor of a watercraft having an engine mounted in accordance with the present invention is reduced as compared to that where the engine is mounted in accordance with the prior art.

Advantageously, the mounting arrangement of the present invention effectively dampens the engine vibration, preventing transmission thereof to the hull of the watercraft. In addition, however, the mounting arrangement permits the height of the engine 122 to be adjusted without changing the dampening constant, so that these height adjustments do not affect the vibration dampening aspects of the mounting.

While a particular means has been described for raising and lowering the pads 154, 168 of the mounts 132*a,b*, 134, it should be understood that other means are available. For example, instead of using threaded nut on each side of the plate through which the shafts 156 and pin 178 extends, the bore therethrough may be threaded for direct engagement of the shafts 156 or pin 178.

Of course, the foregoing description is that of preferred embodiments of the invention, and various changes and modifications may be made without departing from the spirit and scope of the invention, as defined by the appended claims.

What is claimed is:

1. In combination, an internal combustion engine and a watercraft having a water propulsion apparatus and a hull, said engine having a block with a crankshaft extending therefrom in driving relation to said water propulsion apparatus, said crankshaft extending along a first line, said engine having a center of gravity positioned along a second line extending parallel to said first line but laterally offset therefrom, said engine mounted to said hull with a first mount, a second mount, and a third mount, said first and second mounts being positioned on opposite sides of said second line and equidistant therefrom, and said third mount being positioned along said second line.

2. The combination in accordance with claim 1, wherein said engine includes a first bracket and a second bracket, said brackets extending from a lower portion of said engine on opposite sides thereof, and wherein said first and second mounts each comprise a pad connected to a shaft, said each pad engaging one of said brackets, and said shaft supported by said hull.

3. The combination in accordance with claim 2, including means for changing the height of each pad, and thus said engine.

4. The combination in accordance with claim 3, wherein said means comprises threads positioned on said shaft for engagement with a threaded mounting of said hull.

5. The combination in accordance with claim 1, wherein said hull of said watercraft includes an upwardly extending transom at an end thereof and said third mount comprises a bracket extending from a rear end of said engine where said crankshaft thereof extends from, said third mount connecting said engine to said transom.

6. The combination in accordance with claim 5, wherein said bracket includes a pad and a plate engages said pad, said plate connected to said transom.

7. The combination in accordance with claim 6, further including means for adjusting the height of said pad, and thus said engine, with respect to said transom.

8. The combination in accordance with claim 1, wherein said first and second mounts are positioned on opposite sides of said engine and are generally vertically oriented.

9. The combination in accordance with claim 1, wherein said first and second mounts are positioned on opposite sides of said engine and are tilted inwardly towards one another and include a line passing therethrough lying in a plane passes through said center of gravity.

10. The combination in accordance with claim 2, wherein said pad is supported by an upwardly extending shaft.

11. The combination in accordance with claim 2, wherein said engine mounting portion rests upon said pad.

12. A mounting arrangement for an engine powering a water propulsion device of a watercraft having a hull, said mounting arrangement coupling said engine to said hull of said watercraft and including at least two engine mounts for engaging respective mounting portions of said engine, said mounts including a rod connected to said hull and a pad mounted to said rod and means for effectuating a change in height of said pad relative to said hull, said pad engaging said mounting portion of said engine.

13. The mounting arrangement in accordance with claim 12, wherein there are three engine mounts, a first and a second engine mount connecting said engine to said hull at opposite sides of said engine, and a third mount connecting a rear end of said engine to said hull.

14. The mounting arrangement in accordance with claim 13, wherein said first and second mounts are positioned equidistant from a line passing through a center of gravity of the engine and extending parallel to a line extending along a crankshaft of said engine.

15. The mounting arrangement in accordance with claim 12, wherein each mount includes a shaft extending from said pad, and means for changing the position of said shaft relative to said hull.

16. The mounting arrangement in accordance with claim 15, further including an engine support positioned above said hull, and wherein first and second mounts are provided connecting said engine to said support.

17. A watercraft having a hull, a water propulsion device, and an engine powering said water propulsion device, said engine having a cylinder block with a front end, a rear end, a first side and a second side, a crankshaft extending from said rear end of said block in driving relation with said water propulsion device, said crankshaft extending along a first line extending through said block, a center of gravity positioned along a second line, said second line extending parallel to said first line, a first engine mount for mounting said engine to said hull and a second engine mount for mounting said engine to said hull, said first and second mounts positioned generally on opposite sides of said engine and generally equidistant from said second line, and a third mount for mounting said rear end of said engine to said hull, said third mount positioned along said second line, and wherein said first, second and third mounts include a pad engaging said engine and means for moving said pad relative to said hull.

18. The combination in accordance with claim 17, wherein each pad is connected to a shaft and said means for moving comprises a means for raising and lowering said shaft.

19. The combination in accordance with claim 17, wherein said pad of said first and second mounts tilt inwardly towards one another, and a line passing through said pads thereof lies in a plane passing through said second line.

* * * * *